US007945199B2

(12) United States Patent
Kondoh et al.

(10) Patent No.: US 7,945,199 B2
(45) Date of Patent: May 17, 2011

(54) FIXING DEVICE INCLUDING SEPARATION PART FOR SEPARATING MEDIUM FROM FIXING BELT

(76) Inventors: Tsuneaki Kondoh, Kanagawa (JP); Hidenori Machida, Kanagawa (JP); Kohji Kamiya, Kanagawa (JP)

( * ) Notice: Subject to any disclaimer, the term of this patent is extended or adjusted under 35 U.S.C. 154(b) by 765 days.

(21) Appl. No.: 11/936,506

(22) Filed: Nov. 7, 2007

(65) Prior Publication Data

US 2008/0138123 A1 Jun. 12, 2008

(30) Foreign Application Priority Data

Nov. 8, 2006 (JP) ..... 2006-302652

(51) Int. Cl.
*G03G 15/20* (2006.01)

(52) U.S. Cl. ..... 399/329; 399/333

(58) Field of Classification Search ..... 399/323, 399/329, 333; 219/216
See application file for complete search history.

(56) References Cited

U.S. PATENT DOCUMENTS

| | | | | |
|---|---|---|---|---|
| 7,366,456 | B2 * | 4/2008 | Yoshikawa | 399/329 |
| 7,570,911 | B2 * | 8/2009 | Nakafuji et al. | 399/329 |
| 7,725,064 | B2 * | 5/2010 | Egi | 399/323 |

FOREIGN PATENT DOCUMENTS

| | | |
|---|---|---|
| JP | 2003-107947 | 4/2003 |
| JP | 2003-316197 | 11/2003 |
| JP | 2004-191405 | 7/2004 |
| JP | 2006-171551 | 6/2006 |

* cited by examiner

*Primary Examiner* — William J Royer
(74) *Attorney, Agent, or Firm* — Oblon, Spivak, McClelland, Maier & Neustadt, L.L.P.

(57) ABSTRACT

A fixing device including a heating roller; a fixing roller facing the heating roller; a fixing belt wound between the heating roller and the fixing roller, and including, a cylindrical substrate, and an elastic layer provided on or above the substrate except at end parts of the substrate; a pressure roller configured to press the fixing roller through the fixing belt; and a separation part configured to separate media from the fixing belt.

12 Claims, 3 Drawing Sheets

FIXING DEVICE INCLUDING SEPARATION PART FOR SEPARATING MEDIUM FROM FIXING BELT

CROSS-REFERENCE TO RELATED APPLICATIONS

The present application claims the benefit of priority to Japanese Application No. JP2006-302652, filed Nov. 8, 2006, the contents of which are incorporated herein by reference.

BACKGROUND OF INVENTION

1. Field of the Invention

The present invention relates to a fixing belt, a fixing apparatus including the fixing belt and an image forming apparatus including the fixing apparatus.

2. Discussion of the Background

An image forming apparatus, for example, a copier, a printer, or a facsimile heretofore includes a photoconductor drum and forms an electrostatic latent image by exposing a photosensitive layer with a laser beam from a laser scanning unit after the photosensitive layer of the photoconductor drum has received an appropriate charge. After developing the electrostatic latent image using a toner, an image is provided on a transfer paper. After the transfer paper passes through a heat fixing device, the image is fixed.

In such a heat fixing device, a fixing roller includes an adhesive layer composed of a fluorine contained resin layer. The adhesive layer prevents the toner from sticking to a circumferential face of a cored bar composed of, for example, aluminum.

The above described fixing roller includes a heater such as a halogen lamp provided along a centerline of the cored bar which is cylindrical. The fixing roller is heated from inside by heat radiation. The heat fixing device includes a pressure roller which presses the fixing roller. Therefore, the heat fixing device melts and entrenches the toner on the transfer paper by moving the transfer paper through a nipped part between the pressure roller and the fixing roller.

Generally, in such a heat fixing device, the roller is coated with a fluorine contained resin, which easily comes off the roller. However, even if using a coated fixing roller, it is possible that the melted toner will adhere to a surface of the fixing roller and a likelihood exists that the transfer paper will wrap around the fixing roller because the melted toner is doughy and has a high-viscosity. Therefore, the heat fixing device includes a part called an exfoliative click for preventing the transfer paper from wrapping around the fixing roller.

However, in the case that the exfoliative click contacts the fixing roller, the exfoliative click may damage the fixing roller and the damage may result in defective images. As a result, the exfoliative click has been designed to reduce damage to the fixing roller. For example, in some devices, the exfoliative click includes a surface layer composed of a fluorine contained resin, which is an adhesive, and, in other devices, the exfoliative click includes a rounded corner. However, the design of the exfoliative click can still result in damage to the fixing roller resulting in paper powder when paper is transferred between the exfoliative click and the fixing roller.

The following described fixing belt is used for fixing layered multi colored toners on transfer paper. The fixing belt includes an elastic layer composed of silicon rubber on a belt composed of a metal or polyimide and an adhesive layer composed of a fluorine contained resin layer for preventing toner adherence. The fixing belt is provided between a heating roller, which is a cylinder including a heat source internally provided, and a fixing roller faces the heating roller. This heat fixing device includes a pressure roller pressing the fixing roller through the fixing belt. Therefore, the heat fixing device moves the transfer paper through a nipped part between the pressure roller and the fixing belt, melts a toner on the transfer paper by heating the fixing belt, and entrenches a toner on the transfer paper by applying pressure.

However, the above fixing belt has a problem that the exfoliative click may puncture and damage the elastic layer when the exfoliative click contacts the fixing belt.

To address this problem, Japanese Laid-Open Patent Application No. 2006-171551 discloses that the heat fixing device includes a separation board having a width greater than a maximum width of a transfer paper provided at a vent of the nipped part between the pressure roller and the fixing belt. Further, there is a gap provided between the separation board and the fixing belt. Therefore, the heat fixing device prevents the transfer paper from winding around the fixing belt because the separation board separates the transfer paper from the fixing belt. Here, guided part mounted on the separation board contacts a surface of the fixing belt forming the gap.

SUMMARY OF INVENTION

The present inventors recognized that the above-described background art suffers from jamming and smoking because the guided part abrades the fixing belt.

Therefore, an object of the present invention is to provide a novel fixing belt, a novel fixing device, and a novel image forming apparatus, that prevent the guided part from rubbing and damaging the surface of the fixing belt.

DETAILED DESCRIPTION OF THE PREFERRED EMBODIMENTS

Figure 1A:
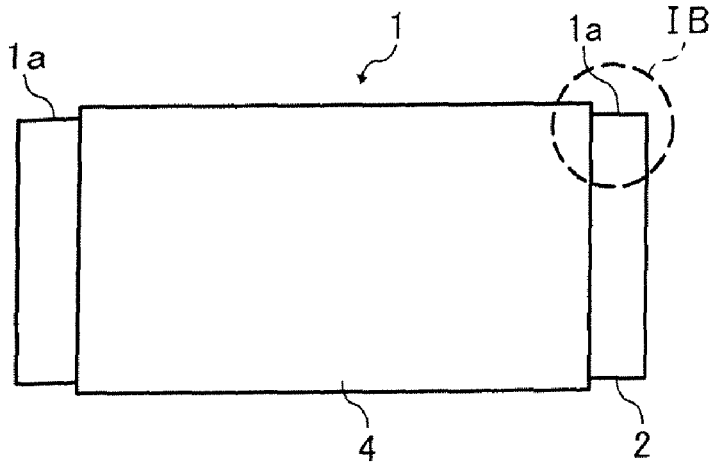
FIG. 1A is a side view of a fixing belt according to a first embodiment of the present invention.
Figure 1B:
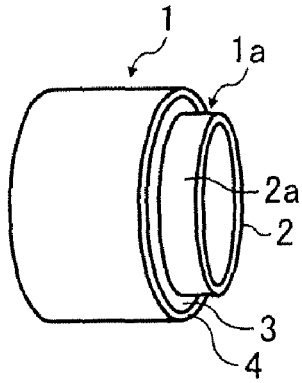
FIG. 1B is an enlarged view of a part IB shown in FIG. 1A.

A first embodiment of the present invention is described below with reference to FIGS. 1A, 1B, 4 and 5. FIG. 1A and FIG. 1B schematically show a fixing belt 1 according to the first embodiment of the present invention.

Figure 4:
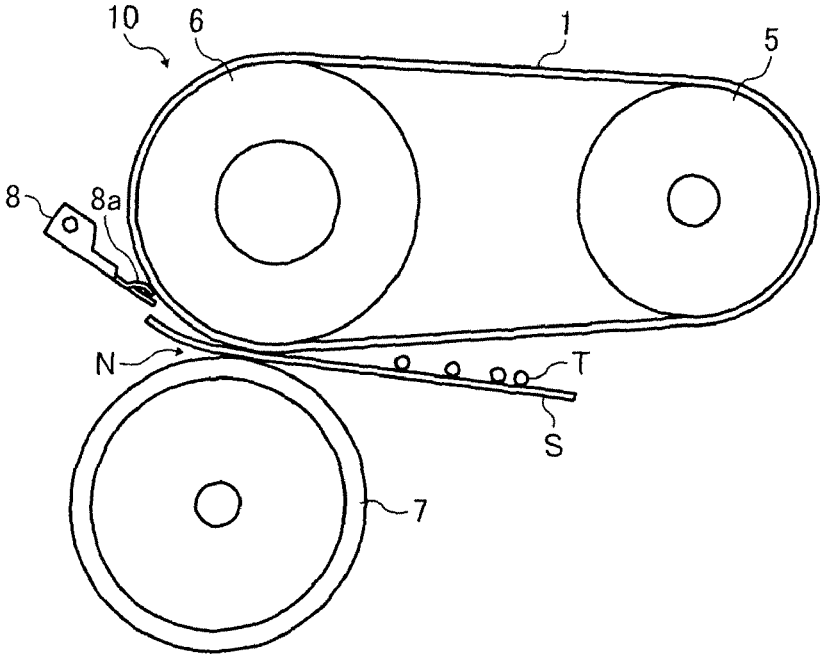
FIG. 4 shows a fixing apparatus including the fixing belt according to the present invention.
Figure 5:
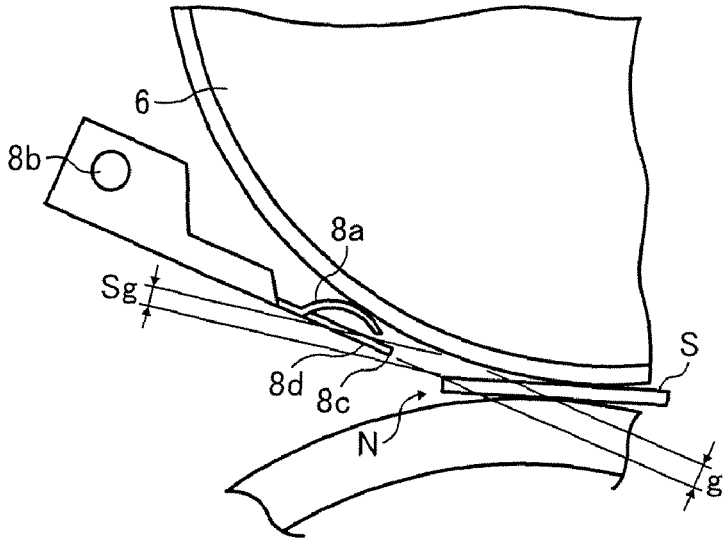
FIG. 5 is an enlarged view showing a contacting part between the fixing belt and a detachment board shown in FIG. 4.

The fixing belt 1 is an edgeless belt and includes multiple layers, a substrate 2, an elastic layer 3, and a releasing layer 4 as shown in FIG. 1B. The fixing belt 1 is provided between a heating roller 5 and a fixing roller 6 facing the heating roller 5 as shown in FIG. 4. A pressure roller 7 presses the heating roller 5 through the fixing belt 1. A nipped part N provided between the pressure roller 7 and the fixing belt 1 is illustrated in FIG. 5. The fixing device includes separation boards 8 each provided outside a width of a maximum width of a transfer paper S, and provided at a vent of the nipped part N between the pressure roller 7 and the fixing belt 1. A guided part 8*a* mounted on the separation boards 8 contact a surface of the fixing belt 1 forming the gap g. See FIG. 5.

Provided below the fixing belt 1 on the substrate 2 are the elastic layer 3 and the releasing layer 4. End parts 1*a* are not provided below the fixing belt 1 and are free to contact the respective separation boards 8.

The substrate 2 of the fixing belt 1 includes a heat-resistant material, for example, a polyimide, a polyamide-imide, a PEEK, a PES, a PPS, a fluorine contained resin and the like. The substrate 2 can include magnetic conducting particles in the heat-resistant material to the extent where 20-90 percent of the mass of the heat-resistant material consists of the particle. Specifically, the magnetic conducting particles are dispersed in a resin material in a varnish state using a dispersing device such as a roll mill, a sand mill, or a defoaming device. Further, the resin material including the magnetic conducting particles is adjusted to an appropriate viscosity using a flux, and is formed using a die.

Further, the substrate 2 may be formed using an alloy material such as nickel, ferrum, or a chrome alloy. A thickness of the substrate 2 is 30 to 500 μm in view of the heat capacity of the substrate 2 and the strength of the substrate 2. Further, in the case of the alloy material, the thickness is preferably less than 100 μm considering that a belt bends, and a curie point is acquired by determining additive amounts for each material and by determining processing conditions. Therefore, in the case where the substrate 2 including the magnetic conducting particles has a curie point around the fixing temperature of the fixing belt 1, the substrate 2 can be heated without the temperature over-rising.

The elastic layer 3 of the fixing belt 1 includes an elastic body, preferably an elastic rubber, such as a silicone rubber and a phlorosilicone rubber. The silicone rubber preferably has a similar heat resistance and hardness as the substrate 2.

The releasing layer 4 of the fixing belt 1 includes a fluorine contained resin such as a tetra fluoro ethylene resin, a tetra fluoro ethylene-perfluoro alkylvinyl ether copolymer (PFA) and a tetra fluoro ethylene-Fluorinated ethylene propylene copolymer (FEP), a mixture of the fluorine contained resins, or a heat resistant resin including the fluorine contained resin. The PFA is selected in view of its strength and flatness. A midair filler and a conductive material are used as a filler in light of its specific heat (lowness) and heat conductivity. These fillers may be used singularly or jointly. The thickness of the releasing layer 4 is 5 to 50 μm, preferably 10 to 30 μm. Therefore, a toner is released from the fixing belt 1. Further, a primer layer may be mounted between each layer of the fixing belt 1.

In order to manufacture the elastic layer 3 and the releasing layer 4 in sequence on the substrate 2 except at end parts 1*a* contacting the separation boards 8 shown as in FIG. 1B, an end part of width direction 2*a* is masked while the elastic layer 3 and the releasing layer 4 are being formed on the substrate 2. Therefore, the elastic layer 3, the releasing layer 4, and the end parts 2*a* are formed simultaneously and a cost of manufacturing of the fixing belt 1 is kept low.

As described above, at the end parts 1*a*, the separation boards 8 contact a surface of the substrate 2 and do not contact the elastic layer 3 and the releasing layer 4. Therefore, the first embodiment prevents a breach and an attrition of a surface of the fixing belt 1. Further, the first embodiment prevents creation of flour caused by the attrition of the fixing belt 1 and defects to images caused by the flour.

In addition, the substrate 2 is formed by the resin material or the alloy material and a hardness of the substrate 2 is quite higher than the hardness of the elastic layer 3 and the releasing layer 4. Therefore, the substrate 2 does not become worn and damaged even when the separation boards 8 contacts the surface of the substrate 2.

Figure 2A:
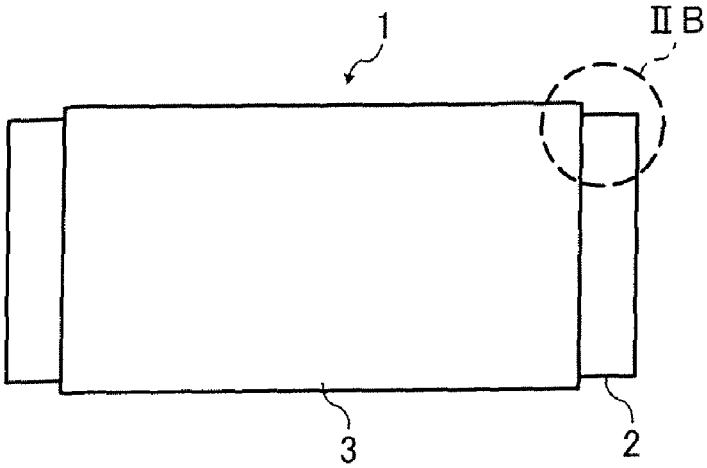
FIG. 2A is a side view of a fixing belt according to a second embodiment of the present invention.
Figure 2B:
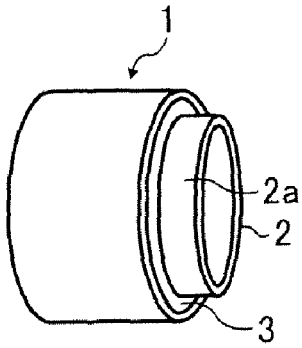
FIG. 2B is an enlarged view of a part IIB shown in FIG. 2A.

A second embodiment of the present invention is described below with reference to FIGS. 2A and 2B. The second embodiment includes a modification of the first embodiment. Only the elastic layer 3 is formed on the substrate 2. The end parts 2*a* are masked while the elastic layer 3 is being formed on the substrate 2 so that the elastic layer 3 is not formed on the end parts 2*a*.

Figure 3A:
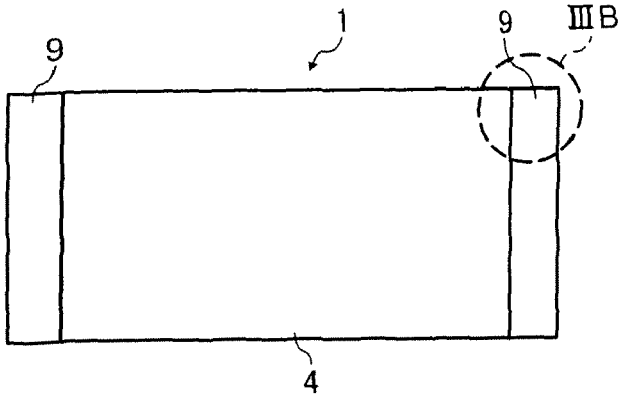
FIG. 3A a side view of a fixing belt according to a third embodiment of the present invention.
Figure 3B:
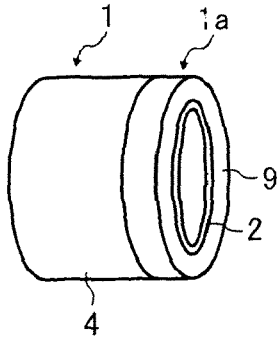
FIG. 3B is an enlarged view of a part IIIC shown in FIG. 3A

A third embodiment of the present invention is described below with reference to FIGS. 3A, 3B, 3C, 4 and 5. FIG. 3A and FIG. 3B schematically show a fixing belt 1 according to the third embodiment of the present invention. In the third embodiment, a surface of the substrate 2 contacting the separation board 2 includes a ring part 9. The fixing belt 1 includes the ring part 9 by encasing the surface of the substrate 8 in the ring part 9. A metal, whose thickness is less than 100 μm is desirable for the ring part 9 to increase endurance. In order to immobilize the ring part 9 against the substrate 2, an adhesive material, for example, is used. A sealant including silicon is desirable for the adhesive material to provide heat resistance.

According to the third embodiment, the elastic layer 3 and the releasing layer 4 are formed on the surface of the substrate 2 except for end parts 1*a* which contact the separation board 8 the same as the first embodiment. However, only the elastic layer 3 may be formed on the substrate 2 the same as the second embodiment.

Figure 3C:
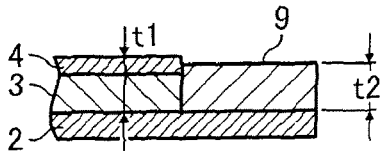
FIG. 3C is a front view of the fixing belt according to the third embodiment.

Further, it is desirable that a total thickness t1 of the elastic layer 3 and the releasing layer 4 is larger than the thickness t2 of the ring part shown in FIG. 3C. The fixing belt 1 presses the transfer paper S adequately such that the transfer paper S is transferred and the third embodiment completes the fixing process reliably.

As described above, at the end parts 1*a*, the separation boards 8 contact a surface of the ring part 9 and do not contact the elastic layer 3 and the releasing layer 4. Therefore, the third embodiment prevents a breach and an attrition of a surface of the fixing belt 1. As discussed above, the first embodiment prevents creation of flour caused by an attrition at the fixing belt 1 and defects of images caused by the flour, and the third embodiment reduces a running cost by requiring replacement of only the ring part 9.

FIG. 4 and FIG. 5 show a fixing device 10 including the fixing belt 1 described in each of the embodiments. The fixing device 10 includes the heating roller 5, the fixing roller 6 facing the heating roller 5, the fixing belt 1 provided between the heating roller 5 and the fixing roller 6, the pressure roller 7 which presses the heat roller 5 through the fixing belt 1, and the separation boards 8 which separate the transfer paper S discharged from the nipped part N between the pressure roller 7 and the fixing belt 1. Thus, the fixing device 10 moves the transfer paper S through the nipped part N between the pressure roller 7 and the fixing belt 1, melts a toner T on the transfer paper S by applying heat to the fixing belt 1 and entrenches the toner T on the transfer paper S by applying pressure.

The fixing device 10 includes the separation boards 8 at a vent of the nipped part N between the pressure roller 7 and the fixing belt 1 and the separation boards 8 are held by a supporting member 8*b*. A head of the separation boards 8, which spread to the vent of the nipped part N, face the fixing belt 1.

The separation boards 8 are formed by a metal such as iron, aluminum, or a stainless alloy. Further, a spacing between the separation boards 8 is larger than a maximum width of the transfer paper S. The separation boards 8 may be formed by a high thermal conducting material. The guided part 8*a* are provided at the head of the separation boards 8. The separation boards 8 are biased by using the supporting member 8*b* as a fulcrum to the fixing belt 1 with a spring part not shown in the figure. Therefore the guided part 8*a* contacts a surface of the fixing belt 1.

A corner part 8*c* of the head of the separation boards 8 is separated from the surface of the fixing belt 1 by the gap g because the guided part 8*a* contacts the fixing belt 1 as shown in FIG. 5. Further, a head of transfer paper S is suspended from the surface of the fixing belt 1 when the fixing device 10 is acting on the transfer paper S is passed out by the nipped part N of the fixing device 10. Therefore, the gap g should be smaller than a suspended length Sg of the transfer paper S. Then, the transfer paper S goes through the side 8*d*, which does not face the fixing belt 1, of the separation boards 8. Therefore, the transfer paper S is separated from the fixing belt 1 and the fixing device 10 prevents the transfer paper S from wrapping around the fixing belt 1 caused by a melted toner.

Figure 6:
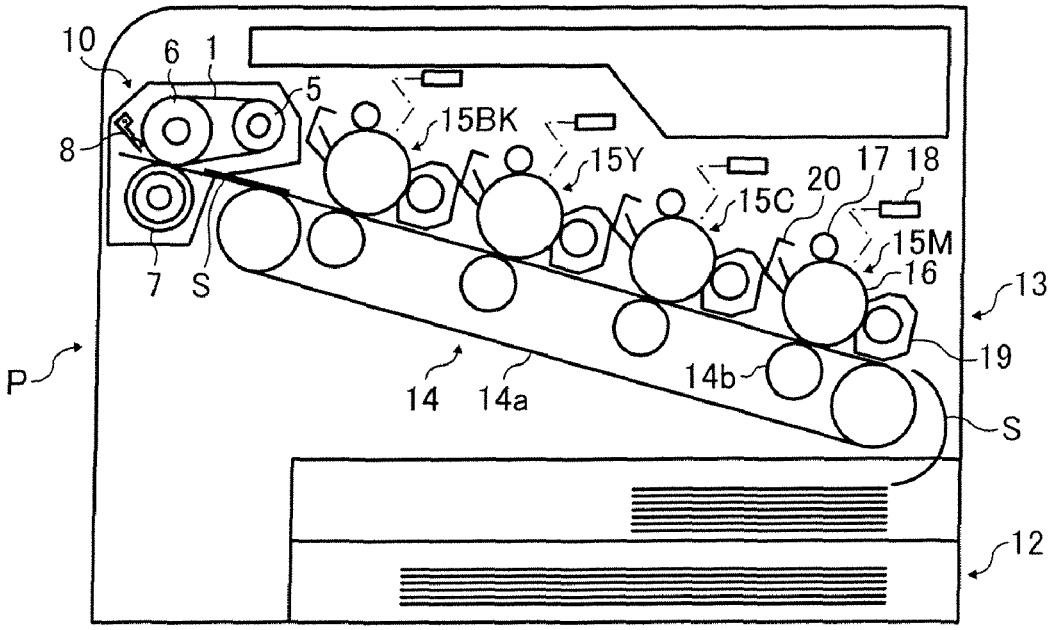
FIG. 6 shows an image forming apparatus including the fixing apparatus.

FIG. 6 shows an image forming apparatus P including the fixing device 10 including the fixing belt 1 described in the above embodiments. The image forming apparatus P is, for example, a full-color printer. The under side of the image forming apparatus P includes a plurality of paper feed trays 12 and the image forming apparatus includes an imaging part 13 at the upper side of the paper feed trays 12.

The imaging part 13 includes a transfer printing belt device 14, whose upper side is a paper ejection side and under side is a paper feed tray side. The transfer printing belt device 14 includes a transfer printing belt 14*a*, which is an edgeless belt wound around a plurality of rollers. The transfer printing belt 14*a* is rotated by a roller rotated by a driving source. The imaging part 13 includes an imaging unit 15M for magenta color, an imaging unit 15C for cyan color, an imaging unit 15Y for yellow color, and an imaging unit 15BK for black color in sequence in an upper plane of the transfer printing belt 14*a*. The imaging part 13 includes the fixing device 10 provided downstream.

The imaging units 15M, 15C, 15Y and 15BK each include a photoreceptor 16 and the photoreceptor 16 is driven clockwise by a driving part not shown. The imaging units 15M, 15C, 15Y and 15BK each include a charging roller 17 as a charging part, an optical laser writing part 18 operating as an exposing part, a development device 19, and cleaning device 20.

The image forming apparatus P, at first, charges the photoreceptor 16 using the charging roller 17, forms an electrostatic latent image on the photoreceptor 16 using a laser beam, develops a magenta-color image as a toner image using the development device 19 of the imaging unit 15M. The transfer paper S is fed by the transfer printing belt 14*a* from the paper feed trays 12 and sent to a transfer printing point facing the photoreceptor 16. At the transfer printing point, the image forming apparatus P transfers the magenta-color image to the transfer paper S using a transfer printing roller 14*b* mounted on the under side of the transfer printing belt 14*a*. The image forming apparatus P forms toner images and transfers the toner images to the transfer paper S one on top of the other in the imaging units 15C, 15Y and 15BK as well as the imaging unit 15M. After the transferring process, the transfer paper S is sent to the fixing device 10 and the fixing device 10 melts the toner image on the transfer paper S and fixes the toner image on the transfer paper S by applying pressure. The fixing device 10 includes the separation boards 8 and prevents the transfer paper S from winding around the fixing belt 1 caused by a melted toner.

Numerous additional modifications and variations are possible in light of the above teachings. It is therefore to be understood that within the scope of the appended claims, the disclosure of this patent specification may be practiced otherwise than as specifically described herein.

A Specific Example 1

A fixing belt 1 is manufactured by the following processes. Both sides of a circular cylinder substrate 2, which is formed by a polyimide and whose length is 320 mm and thickness is 50 μm, is masked by a tape. A width of masking is 15 mm on both sides. The primer layer is coated on the substrate 2 as a first layer and is dried. Further, a silicon material (DY39-2083; TORAY) is coated on the primer layer as an elastic layer 3 and is vulcanized. The thickness of the elastic layer 3 is 200 μm. The primer layer is coated on the elastic layer 3. A PFA, whose thickness is 20 μm, is coated on a primer layer as a releasing layer 4. The PFA is a shattered fluorine contained resin (MP102; DU PONT MITSUI FLUOROCHEMICALS). After the above, the tape is peeled and the circular cylinder substrate 2, the elastic layer 3, the releasing layer 4 and the primer layers are powder-coated, and are burned at 340° C. for 30 minutes and cooled at room temperature.

A Specific Example 2

A fixing belt 1 is manufactured by the following processes. Both sides of the fixing belt 1 are encased by a ring part 9, whose thickness is 50 μm, has an inside diameter of 60.1 mm and which is cylindrical metal (e.g., SUS304). The fixing belt 1 and the ring part 9 are fixed by an adhesive material (e.g., TE 387; MOMENTIVE PERFORMANCE MATERIALS).

A Comparative Example

A fixing belt is manufactured by the following processes. An elastic layer 3 and a releasing layer 4 are coated on the whole surface of a substrate 2. The fixing belt 1 of the comparative example is the same as the fixing belt of the specific example 1 except for the above distinction.

A test of sending paper through the fixing belts 1 is conducted using three fixing belts: the specific example 1, the specific example 2, and the comparative example. The test uses 200,000 sheets of paper. A depth of rubbing at the end parts 1*a* and damage to the image are checked during the test. The results were as follows:

TABLE 1

| | Depth of rubbing | Damage of image |
|---|---|---|
| specific example 1 | 2 | 3 |
| specific example 2 | 3 | 3 |
| comparative example | 1 | 1 |

Table 2 indicates an assessment criterion.

TABLE 2

| | Rank | Acceptable rank |
|---|---|---|
| Depth of rubbing | Bad 1 ←→ 3 Good | More than 2 |
| Damage of image | Bad 1 ←→ 3 Good | More than 2 |

As is clear from table 1, a surface of the fixing belt 1 of the comparative example is damaged by rubbing at a contact part with the separation board 8. Further, flour caused by rubbing generates damage to the image when the flour attaches to the transfer paper S. However, the results indicate that the fixing belts 1 of the specific examples 1 and 2 have an effect of reducing an influence of rubbing and preventing damage to the image caused by the flour.

What is claimed is:

1. A fixing device, comprising:

a heating roller;

a fixing roller facing the heating roller;

a fixing belt wound between the heating roller and the fixing roller, and including, a cylindrical substrate, and an elastic layer provided on or above the substrate except at end parts of the substrate;

a pressure roller configured to press the fixing roller through the fixing belt; and a separation part configured to separate medium from the fixing belt.

2. The fixing device according to claim 1, wherein the fixing belt further comprises:

a releasing layer on or above the elastic layer.

3. The fixing device according to claim 1, wherein the separation part is configured to separate the medium from the fixing belt at the ends of the fixing belt.

4. The fixing device according to claim 1, wherein the fixing belt further comprises:

a ring part provided on the end parts.

5. An image forming apparatus, comprising:

a fixing device including, a heating roller;

a fixing roller facing the heating roller;

a fixing belt wound between the heating roller and the fixing roller, and including, a cylindrical substrate, and an elastic layer provided on or above the substrate except at end parts of the substrate;

a pressure roller configured to press the fixing roller through the fixing belt; and a separation part configured to separate a medium from the fixing belt.

6. The image forming apparatus according to claim 5, wherein the fixing belt further comprises:

a releasing layer on or above the elastic layer.

7. The fixing device according to claim 5, wherein the separation part is configured to separate the medium from the fixing belt at the ends of the fixing belt.

8. The fixing device according to claim 5, wherein the fixing belt further comprises:

a ring part provided on the end parts.

9. A fixing device, comprising:

a heating roller;

a fixing roller facing the heating roller;

a fixing belt wound between the heating roller and the fixing roller, and including, a cylindrical substrate, and an elastic layer provided on or above the substrate except at end parts of the substrate;

a pressure roller configured to press the fixing roller through the fixing belt; and means for separating a medium from the fixing belt.

10. The fixing device according to claim 9, wherein the fixing belt further comprises:

a releasing layer on or above the elastic layer.

11. The fixing device according to claim 9, wherein the means for separate the medium from the fixing belt at the ends of the fixing belt.

12. The fixing device according to claim 9, wherein the fixing belt further comprises:

a ring part provided on the end parts.

* * * * *